US005308731A

United States Patent [19]

Larson et al.

[11] Patent Number: 5,308,731

[45] Date of Patent: May 3, 1994

[54] LIQUID DEVELOPER COMPOSITIONS WITH ALUMINUM HYDROXYCARBOXYLIC ACIDS

[75] Inventors: James R. Larson, Fairport; Bing R. Hsieh, Webster, both of N.Y.

[73] Assignee: Xerox Corporation, Stamford, Conn.

[21] Appl. No.: 9,192

[22] Filed: Jan. 25, 1993

[51] Int. Cl.[5] ..... G03G 9/135

[52] U.S. Cl. ..... 430/115

[58] Field of Search ..... 430/115

[56] References Cited

U.S. PATENT DOCUMENTS

| | | | |
|---|---|---|---|
| 3,576,744 | 4/1971 | Sharrock et al. | 430/115 X |
| 4,707,429 | 11/1987 | Trout | 430/115 |
| 4,760,009 | 7/1988 | Larson | 430/137 |
| 4,859,559 | 8/1989 | Trout | 430/115 |
| 4,994,341 | 2/1991 | Adair et al. | 430/115 |
| 5,002,848 | 3/1991 | El-Sayed et al. | 430/115 |
| 5,019,477 | 5/1991 | Felder | 430/115 |
| 5,028,508 | 7/1991 | Lane et al. | 430/115 |
| 5,030,535 | 7/1991 | Drappel et al. | 430/116 |
| 5,034,299 | 7/1991 | Houle et al. | 430/115 |
| 5,045,425 | 9/1991 | Swidler | 430/115 |
| 5,066,821 | 11/1991 | Houle et al. | 430/137 |
| 5,069,995 | 12/1991 | Swidler | 430/115 |
| 5,153,090 | 10/1992 | Swidler | 430/115 |

FOREIGN PATENT DOCUMENTS

| | | | |
|---|---|---|---|
| 6503678 | 9/1965 | Netherlands | 430/115 |

*Primary Examiner*—Roland Martin

*Attorney, Agent, or Firm*—E. O. Palazzo

[57] ABSTRACT

A liquid developer comprised of a liquid, thermoplastic resin particles, a nonpolar liquid soluble charge director, and a charge adjuvant comprised of a metal hydroxycarboxylic acid.

28 Claims, No Drawings

LIQUID DEVELOPER COMPOSITIONS WITH ALUMINUM HYDROXYCARBOXYLIC ACIDS

BACKGROUND OF THE INVENTION

This invention is generally directed to liquid developer compositions and, in particular, to a liquid developer containing metal hydroxy acid complexes as charge adjuvants. More specifically, the present invention relates to liquid developers containing aluminum hydroxycarboxylic acids, such as aluminum salicylate. The developers of the present invention can be selected for a number of known imaging and printing systems, such as xerographic processes, wherein latent images are rendered visible with the liquid developer illustrated herein. The image quality, solid area coverage and resolution for developed images usually require sufficient toner particle electrophoretic mobility. The mobility for effective image development is primarily dependent on the imaging system used. The electrophoretic mobility is primarily directly proportional to the charge on the toner particles and inversely proportional to the viscosity of the liquid developer fluid. A 10 to 30 percent change in fluid viscosity caused, for instance, by a 5° to 15° C. decrease in temperature could result in a decrease in image quality, poor image development and background development, for example, because of a 5 percent to 23 percent decrease in electrophoretic mobility. Insufficient particle charge can also result in poor transfer of the toner to paper or other final substrates. Poor or unacceptable transfer can result in, for example, poor solid area coverage if insufficient toner is transferred to the final substrate and can also lead to image defects such as smears and hollowed fine features. To overcome or minimize such problems, the liquid toners of the present invention were arrived at after extensive research efforts, and which toners result in, for example, sufficient particle charge for transfer and maintain the mobility within the desired range of the particular imaging system employed. Advantages associated with the present invention include increasing the desired negative charge on the developer particles and in embodiments providing a charge adjuvant, also referred to as a charge additive, that is superior to other charge adjuvants, like aluminum stearate. The superior charge can result in improved image development and superior image transfer.

A latent electrostatic image can be developed with toner particles dispersed in an insulating nonpolar liquid. The aforementioned dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, it is developed by colored toner particles dispersed in a nonpolar liquid. The image may then be transferred to a receiver sheet.

Useful liquid developers can comprise a thermoplastic resin and a dispersant nonpolar liquid. Generally, a suitable colorant, such as a dye or pigment, is also present. The colored toner particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm average by area size as measured using the Malvern 3600E particle sizer.

Since the formation of proper images depends, for example, on the difference of the charge between the toner particles in the liquid developer and the latent electrostatic image to be developed, it has been found desirable to add a charge director compound and charge adjuvants which increase the magnitude of the charge, such as polyhydroxy compounds, amino alcohols, polybutylene succinimide compounds, aromatic hydrocarbons, metallic soaps, and the like to the liquid developer comprising the thermoplastic resin, the nonpolar liquid and the colorant.

U.S. Pat. No. 5,019,477 to Felder, the disclosure of which is hereby totally incorporated by reference, discloses a liquid electrostatic developer comprising a nonpolar liquid, thermoplastic resin particles, and a charge director. The ionic or zwitterionic charge directors may include both negative charge directors such as lecithin, oil-soluble petroleum sulfonate and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer of (iii) selected from the group consisting of vinyl toluene and styrene and (iv) selected from the group consisting of butadiene and acrylate. As the copolymer of polyethylene and methacrylic acid or methacrylic acid alkyl esters, NUCREL ® may be selected.

U.S. Pat. No. 5,030,535 to Drappel et al. discloses a liquid developer composition comprising a liquid vehicle, a charge control additive and toner particles. The toner particles may contain pigment particles and a resin selected from the group consisting of polyolefins, halogenated polyolefins and mixtures thereof. The liquid developers are prepared by first dissolving the polymer resin in a liquid vehicle by heating at temperatures of from about 80° C. to about 120° C., adding pigment to the hot polymer solution and attriting the mixture, and then cooling the mixture so that the polymer becomes insoluble in the liquid vehicle, thus forming an insoluble resin layer around the pigment particles.

U.S. Pat. Nos. 3,852,208 and 3,933,664, both to Nagashima et al., disclose colored, light-transparent photoconductive material which is obtained by a condensation reaction of organic photoconductive substances with reactive colored components. The chemical combination of an organic photoconductive substance having at least one amino or hydroxyl group with a color development component having at least one active halogen atom produces the color developing organic photoconductive materials. Alternatively, the color developing materials can be obtained from the combination of an organic photoconductive substance having at least one active halogen atom with a color developing component having at least one amino or hydroxyl group. The color developing organic photoconductive material may be pulverized in a ballmill, a roll-mill or an atomizer to produce a toner for use as a dry or wet developing agent, or may be used in combination with other colored substances or vehicle resins.

U.S. Pat. No. 4,524,119 to Luly et al. discloses electrophotographic dry development carriers for use with toner particles wherein the carrier core particles are coated with fluorinated carbon or a fluorinated carbon-containing resin. By varying the fluorine content of the fluorinated carbon, systematic uniform variation of the resistivity properties of the carrier is permitted. Suitable binders for use with the carrier core particles may be selected from known thermoplastics, including fluoropolymers.

U.S. Pat. No. 5,026,621 to Tsubuko et al. discloses a toner for electrophotography which comprises as main components a coloring component and a binder resin which is a block copolymer comprising a functional segment (A) consisting of at least one of a fluoroalkylacryl ester block unit or a fluoroalkyl methacryl ester block unit, and a compatible segment (B) consisting of a fluorine-free vinyl or olefin monomer block unit. The functional segment of block copolymer is oriented to the surface of the block polymer and the compatible segment thereof is oriented to be compatible with other resins and a coloring agent contained in the toner, so that the toner is provided with both liquid repelling and solvent soluble properties.

U.S. Pat. No. 4,248,954 to Datta et al. discloses carrier particles for use with a dry toner composition in an electrophotographic process, which are prepared by coating the surface of the carrier particles with a perfluoro carboxylic acid in a polymeric binder. The carrier particles are capable of imparting a positive triboelectric charge to toners used with these carrier particles.

U.S. Pat. No. 4,268,598 to Leseman et al. discloses a developing powder composition prepared by blending a fluoroaliphatic sulfonamido surface active agent with a desired formulation of toner powder particles. The toner powders are flowable, finely divided dry powder that are generally colored and are preferably conductive and magnetically attractable.

U.S. Pat. No. 4,139,483 to Williams et al. discloses a finely divided dry toner composition comprising a colorant, a thermoplastic resin, and a surface active additive which is capable of providing a desired polarity and magnitude of triboelectric charging potential to the toner composition. The surface active additives are selected from highly fluorinated materials.

U.S. Pat. No. 4,113,641 to Brana et al. discloses a dry development powder with a high charge to mass ratio comprising a carrier particle treated with a perfluoroalkyl sulfonic acid. The core of the carrier particle is any material which can react chemically with perfluoro sulfonic acid, and is preferably a ferromagnetic material such as iron or steel.

U.S. Pat. No. 4,388,396 to Nishibayashi et al. discloses developer particles comprising pigment particles, a binder and an offset-preventing agent selected from the group consisting of aliphatic fluorocarbon compounds and fluorochlorocarbon compounds. Electrical conductivity can be imparted to the developer by causing electrically conductive fine particles to adhere to the surfaces of the particles.

U.S. Pat. No. 4,468,446 to Mikami et al. discloses a dry electrostatographic toner for a pressure fixing process which comprises encapsulated toner particles with a pressure fixable adhesive core material containing a colorant and a pressure rupturable shell enclosing the core material, wherein the outer surface of the shell is an organofluoro compound.

Moreover, in U.S. Pat. No. 4,707,429 there are illustrated, for example, liquid developers with an aluminum stearate charge additive. Liquid developers with charge directors are also illustrated in U.S. Pat. No. 5,045,425. Further, stain elimination in consecutive colored liquid toners is illustrated in U.S. Pat. No. 5,069,995. Additionally, of interest are U.S. Pat. Nos. 4,760,009; 5,034,299 and 5,028,508.

The disclosures of each of the U.S. patents mentioned herein are totally incorporated herein by reference.

In copending patent application U.S. Ser. No. 986,316, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., said developer having a melting point of at least about 25° C., said contact occurring while the developer is maintained at a temperature at or above its melting point, said developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

SUMMARY OF THE INVENTION

It is an object of the present invention to provide liquid developers with many of the advantages illustrated herein.

Another object of the present invention is to provide liquid developers capable of high particle charging.

It is a further object of the invention to provide a negatively charged liquid developer wherein there is selected as charge adjuvants metal, such as aluminum hydroxycarboxylic acids.

It is still a further object of the invention to provide a liquid developer wherein developed image defects such as smearing, loss of resolution and loss of density are eliminated, or minimized.

Also, in another object of the present invention there are provided negatively charged liquid developers with certain charge adjuvants, which are superior in embodiments to, for example, aluminum stearate, since for example they result in higher negative particle charge. The superior charge can result in improved image development and excellent image transfer.

Another object of the present invention resides in the provision of negatively charged liquid toners with metal hydroxycarboxylic acid complexes, and wherein in embodiments enhancement of the negative charge of NUCREL® based toners, especially cyan toners, is enhanced.

These and other objects of the present invention can be accomplished in embodiments by the provision of liquid developers with certain charge adjuvants. In embodiments, the present invention is directed to liquid developers comprised of a toner resin, pigment, and a charge additive comprised of aluminum hydroxycarboxylic acids.

Embodiments of the present invention relate to a liquid developer comprised of a liquid, thermoplastic resin particles, a nonpolar liquid soluble charge director, and a charge adjuvant comprised of a metal, such as an aluminum hydroxycarboxylic acid; a liquid developer comprised of a nonpolar liquid, thermoplastic resin particles, a nonpolar liquid soluble ionic or zwitterionic charge director, and a charge adjuvant comprised of an aluminum hydroxycarboxylic acid, or mixtures thereof; a liquid electrostatographic developer comprised of a nonpolar liquid, thermoplastic resin particles, a nonpolar liquid soluble ionic or zwitterionic charge director compound, and a charge adjuvant comprised of an aluminum hydroxycarboxylic acid, or mixtures thereof; or a liquid electrostatographic developer comprised of (A) a nonpolar liquid having a Kauri-butanol value of from about 5 to about 30, and present in a major amount of from about 50 percent to about 95 weight percent, (B) thermoplastic resin particles having an average volume particle diameter of from about 5 to about 30 microns, (C) a nonpolar liquid soluble ionic or zwitterionic charge director compound, and (D) a charge adjuvant comprised of aluminum hydroxycarboxylic acid, the corresponding hydrates, or mixtures thereof.

Examples of specific charge adjuvants present in various effective amounts of, for example, from about 0.25 to about 15, and preferably from about 0.5 to about 5 weight percent include certain salicylic acids and the derivatives thereof, such as 3-, 4-, or 5-methyl salicylic acid, 5-t-butylsalicylic acid, 3-isopropylsalicylic acid, 3,5-di-isopropylsalicylic acid, 3-isopropyl-6-methylsalicylic acid, 3-t-butyl-5-methylsalicylic acid, 3-t-butyl-6-methylsalicylic acid and the like. Also included are derivatives of hydroxy naphthoic acid derivatives, such as 1-hydroxy-2-naphthoic acid, 2-hydroxy-1-napthoic acid, 3-hydroxy-2-naphthoic acid and the like. And also included are aliphatic $\alpha$ or $\beta$-hydroxy carboxylic acids, such as glycolic acid, mandelic acid, benzilic acid, lactic acid, atrolactic acid, malic acid, citric acid, isocitric acid, and the like. Further, in embodiments there may be selected mixtures of aluminum hydroxycarboxylic acids with different molar ratios, such as 1:1, 1:2, 1:3, and the like wherein the first number 1 represents the metal, such as aluminum, especially aluminum (III), and the second number represents the hydroxy carboxylic acid portion. Thus, mixtures with from about 50 to about 70 weight percent of the 1:2, from about 35 to about 20 of the 1:3, and from about 10 to about 5 of the 1:1 can be selected.

Examples of liquid carriers selected for the developers of the present invention include a liquid with viscosity of from about 0.5 to about 500 centipoise, preferably from about 1 to about 20 centipoise, and a resistivity greater than or equal to $5\times10^9$ ohm/centimeters, such as $10^{13}$ ohm/cm or more. Preferably, the liquid selected in embodiments is a branched chain aliphatic hydrocarbon. A nonpolar liquid of the ISOPAR ® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G ® is between about 157° C. and about 176° C.; ISOPAR H ® is between about 176° C. and about 191° C.; ISOPAR K ® is between about 177° C. and about 197° C.; ISOPAR L ® is between about 188° C. and about 206° C.; ISOPAR M ® is between about 207° C. and about 254° C.; and ISOPAR V ® is between about 254.4° C. and about 329.4° C. ISOPAR L ® has a mid-boiling point of approximately 194° C. ISOPAR M ® has an auto ignition temperature of 338° C. ISOPAR G ® has a flash point of 40° C. as determined by the tag closed cup method; ISOPAR H ® has a flash point of 53° C. as determined by the ASTM D-56 method; ISOPAR L ® has a flash point of 61° C. as determined by the ASTM D-56 method; and ISOPAR M ® has a flash point of 80° C. as determined by the ASTM D-56 method. The the liquids selected are known and should have an electrical volume resistivity in excess of $10^9$ ohm-centimeters and a dielectric constant below or equal to 3.0. Moreover, the vapor pressure at 25° C. should be less than or equal to 10 Torr in embodiments.

While the ISOPAR ® series liquids are the preferred nonpolar liquids in embodiments for use as dispersants in the liquid developers of the present invention, the important characteristics of viscosity and resistivity can be achieved it is believed with other suitable liquids. Specifically, the NORPAR ® series available from Exxon Corporation, the SOLTROL ® series from the Phillips Petroleum Company, and the SHELLSOL ® series from the Shell Oil Company can be selected.

The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Any suitable thermoplastic toner resin can be selected for the liquid developers of the present invention in effective amounts of, for example, in the range of 99 percent to 40 percent of developer solids, and preferably 95 percent to 70 percent of developer solids; developer solids includes the thermoplastic resin, optional pigment and charge control agent and any other component that comprises the particles. Examples of such resins include ethylene vinyl acetate (EVA) copolymers (ELVAX ® resins, E. I. DuPont de Nemours and Company, Wilmington, Del.); copolymers of ethylene and an $\alpha$-$\beta$-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series sold under the trademark BAKELITE ® DPD 6169, DPDA 6182 Natural (Union Carbide Corporation); ethylene vinyl acetate resins, for example DQDA 6832 Natural 7 (Union Carbide Corporation); SURLYN ® ionomer resin (E. I. DuPont de Nemours and Company); or blends thereof; polyesters; polyvinyl toluene; polyamides; styrene/butadiene copolymers; epoxy resins; acrylic resins, such as copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE ® acrylic resins (E. I. DuPont de Nemours and Company); or blends thereof. Preferred copolymers are the copolymer of ethylene and an $\alpha$-$\beta$-ethylenically unsaturated acid of either acrylic acid or methacrylic acid. In a preferred embodiment, NUCREL ®, like NUCREL ®599, NUCREL ®699, or NUCREL ® 960 are selected as the thermoplastic resin.

The liquid developer of the present invention may optionally contain a colorant dispersed in the resin particles. Colorants, such as pigments or dyes and mixtures thereof, are preferably present to render the latent image visible.

The colorant may be present in the resin particles in an effective amount of, for example, from about 0.1 to about 60 percent, and preferably from about 1 to about 30 percent by weight based on the total weight of solids contained in the developer. The amount of colorant used may vary depending on the use of the developer. Examples of colorants include pigments like carbon blacks like REGAL 330®, cyan, magenta, yellow, blue, green, brown and mixtures thereof; pigments as illustrated in copending patent application U.S. Ser. No. 755,919, the disclosure of which is totally incorporated herein by reference, and more specifically, the following.

| PIGMENT BRAND NAME | MANUFACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, CI 77266 |
| UHLICH ® BK 8200 | Paul Uhlich | Black |

Suitable nonpolar liquid soluble ionic or zwitterionic charge directir compounds which are selected in various effective amounts such as about 0.25 to 1,500 milligrams/gram, preferably 2.5 to 400 milligrams/gram based on the amount of developer solids comprised of resin, pigment, and charge adjuvant, include anioic glyceride, such as EMPHOS D70-30C TM and EMPHOS F27-85 ®, two products available from Witco Corporation, New York, N.Y.; which are sodium salts of phosphated mono and diglycerides with unsaturated and saturated acid substituents, respectively, lecithin, BASIC BARIUM PETRONATE®, NEUTRAL BARIUM PETRONATE®, CALCIUM PETRONATE®, NEUTRAL CALCIUM PETRONATE®, oil soluble petroleum sulfonates, Witco Corporation, New York, N.Y.; and metallic soaps such as barium, calcium, lead, and zinc stearates; cobalt, manganese, lead, and zinc linoleates, calcium and cobalt octoates; quaternary ammonium block copolymers as illustrated, for example, in U.S. Pat. No. 5,035,972, the disclosure of which is totally incorporated herein by reference, and the like.

The charge on the toner particles alone may be measured in terms of particle mobility using a high field measurement device. Particle mobility is a measure of the velocity of a toner particle in a liquid developer divided by the size of the electric field within which the liquid developer is employed. The greater the charge on a toner particle, the faster it moves through the electrical field of the development zone. The movement of the particle is required for image development and background cleaning.

Toner particle mobility can be measured using the electroacoustics effect, the application of an electric field, and the measurement of sound reference Oja et. al. U.S. Pat. No. 4,497,208, the disclosure of which is totally incorporated herein by reference. This technique is particularly useful for nonaqueous dispersions because the measurements can be made at high volume loadings, for example, greater than or equal to 1.5 to 10 weight percent. Measurements made by this technique have been shown to correlate with image quality, for example high mobilities can lead to improved image density, resolution and improved transfer efficiency. Residual conductivity, that is the conductivity from the charge director, is measured using a low field device as illustrated in the following Examples.

The liquid electrostatic developer of the present invention can be prepared by a variety of known processes such as, for example, mixing in a nonpolar liquid the thermoplastic resin, nonpolar liquid charging additive and colorant in a manner that the resulting mixture contains, for example about 15 to about 30 percent by weight of solids; heating the mixture to a temperature from about 70° C. to about 130° C. until a uniform dispersion is formed; adding an additional amount of nonpolar liquid sufficient to decrease the total solids concentration of the developer to about 10 to 20 percent by weight; cooling the dispersion to about 10° C. to about 50° C.; adding the charge adjuvant compound to the dispersion; and diluting the dispersion.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer (manufactured by Charles Ross and Son, Hauppauge, N.Y.), or a two roll heated mill, which requires no particulate media. Useful particulate media include particulate materials like a spherical cylinder selected from the group consisting of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters).

Sufficient, nonpolar liquid is added to provide a dispersion of from about 15 to about 50 percent solids. This mixture is subjected to elevated temperatures during the initial mixing procedure to plasticize and soften the resin. The mixture is sufficiently heated to provide a uniform dispersion of all solid materials, that is colorant, adjuvant and resin. However, the temperature at which this step is undertaken should not be so high as to degrade the nonpolar liquid or decompose the resin or colorant when present. Accordingly, the mixture is heated to a temperature of from about 70° C. to about 130° C., and preferably to about 75° C. to about 110° C. The mixture may be ground in a heated ball mill or heated attritor at this temperature for about 15 minutes to 5 hours, and preferably about 60 to about 180 minutes.

After grinding at the above temperatures, an additional amount of nonpolar liquid may be added to the dispersion. The amount of nonpolar liquid to be added at this point should be an amount sufficient to decrease the total solids concentration of the dispersion to from about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid, such as water, ethylene glycol, and the like in a jacket surrounding the mixing vessel. Cooling may be accomplished, for example, in the same vessel, such as the attritor, while simultaneously grinding with particulate media to prevent the formation of a gel or solid mass; without stirring to form a gel or solid mass, followed by shredding the gel or solid mass and grinding by means of particulate media, or with stirring to form a viscous mixture and grinding by means of particulate media. The resin precipitate is cold ground for about 1 to 36 hours, and preferably 2 to 6 hours. Additional liquid may be added at any step during the preparation of the liquid developer to facilitate grinding or to dilute the developer to the appropriate percent solids needed for developing. Methods for the preparation of toners that can be selected are illustrated in U.S. Pat. Nos. 4,760,009; 5,017,451; 4,923,778 and 4,783,389, the disclosures of which are totally incorporated herein by reference.

Methods of imaging are also encompassed by the present invention wherein after formation of a latent image on a photoconductive imaging member, reference copending patent application U.S. Ser. No. 07/009 202), the disclosure of which is totally incorporated herein by reference, the image is developed with the liquid toner illustrated herein by, for example, immersion of the photoconductor therein, followed by transfer and fixing of the image.

The invention will further be illustrated in the following nonlimiting Examples, it being understood that these Examples are intended to be illustrative only and that the invention is not intended to be limited to the materials, conditions, process parameters and the like recited herein. The conductivity of the liquid toner dispersions and charge director solutions were determined with a Scientifica 627 Conductivity Meter (Scientifica, Princeton, N.J.). The measurement signal for this meter is a low distortion 18 hz sine wave with an amplitude of 5.4 to 5.8 volts rms. Toner particle mobilities and zeta potentials were determined with a MBS-8000 electrokinetic sonic analysis (ESA) system (Matec Applied Science Hopkinton, Mass.). The system was calibrated in the aqueous mode per manufacturer's recommendation to give an ESA signal corresponding to a zeta potential of −26 mv for a 10 percent (v/v) suspension of LUDOX TM (DuPont). The system was then set up for nonaqueous measurements. The toner particle mobility is dependent on a number of factors including particle charge and particle size. The ESA system also calculates the zeta potential which is directly proportional to toner charge and is independent of particle size. Particle size was measured by two methods: (1) The Malvern 3600E Particle Sizer manufactured by Malvern, Southborough, Mass. uses laser diffraction light scattering of stirred samples to determine average particle sizes; and (2) Horiba CAPA-500 centrifugal automatic particle analyzer, manufactured by Horiba Instruments, Inc, Irvine, Calif. Since the Malvern and Horiba instruments use different techniques to measure average particle size, the readings may differ. The following correlation of the average size of toner particles (average volume diameter of resin, pigment, and charge additive mixture product) in microns for the two instruments was

| VALUE DETERMINED BY MALVERN 3600E PARTICLE SIZER | EXPECTED RANGE FOR HORIBA CAPA-500 |
|---|---|
| 30 | 9.9 +/− 3.4 |
| 20 | 6.4 +/− 1.9 |
| 15 | 4.6 +/− 1.3 |
| 10 | 2.8 +/− 0.8 |
| 5 | 1.0 +/− 0.5 |
| 3 | 0.2 +/− 0.6 |

Specific embodiments of the invention will now be described in detail. These Examples are intended to be illustrative, and the invention is not limited to the materials, conditions, or process parameters set forth in these embodiments. All parts and percentages are by weight unless otherwise indicated. Control Examples are also provided.

CONTROL 1

Twenty-seven (27) grams of NUCREL 599® (a copolymer of ethylene and methacrylic acid with a melt index at 190° C. of 500 dg/minute, available from E. I. DuPont de Nemours & Company, Wilmington, Del.), 3 grams of the cyan pigment (NBD 7010, BASF, Holland, Mich.) and 170 grams of NORPAR 15®, carbon chain of 15 average (Exxon Corporation) are added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 70° to 100° C. for 1 hour and cooled by running water through the attritor jacket to 15° C. and ground in the attritor for an additional 4 hours. Additional NORPAR 15® was added and the mixture was separated by the use of a metal grate from the steel balls yielding 350 grams of 1.61 percent solids by weight. The particle size was 7.2 microns for the V (50) (the volume weighted average particle size) measured with a Malvern 3600E particle size analyzer. 0.562 gram of BASIC BARIUM PETRONATE® (Witco Chemical Corporation, New York, N.Y.) was added to the dispersion. The mobility of the toner was measured and the result is presented hereinafter.

CONTROL 2

Two hundred (200) grams of NUCREL 599® (a copolymer of ethylene and methacrylic acid with a melt index at 190° C. of 500, available from E. I. DuPont de Nemours & Company, Wilmington, Del.), 22.7 grams of the cyan pigment (NBD 7010, BASF, Holland, Mich.), and 4.5 grams of aluminum stearate, one of the commercially used liquid developer charge adjuvant, Witco 22, (Witco Chemical Corporation, New York, N.Y.), and 1,287 grams of NORPAR 15® (Exxon Corporation) are added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 60° to 85° C. for 2 hours and cooled by running water through the attritor jacket to 18° C. and ground in the attritor for an additional 6 hours. Additional NORPAR 15® was added and the mixture is separated by the use of a metal grate from the steel balls. The particle size was 7.0 microns for the V (50) (the volume weighted average particle size) measured with a Malvern 3600E particle size analyzer. The dispersion was diluted to 2 percent solids and 343 grams of the diluted dispersion were charged to form negative particles by the addition of 0.7 gram of BASIC BARIUM PETRONATE® (Witco Chemical Corporation, New York, N.Y.). The mobility of the toner was measured and the result is presented hereinafter.

EXAMPLE I

Twenty-seven (27) grams of NUCREL 599® (a copolymer of ethylene and methacrylic acid with a melt index at 190° C. of 500, available from E. I. DuPont de Nemours & Company, Wilmington, Del.), 3 grams of the cyan pigment (NBD 7010, BASF, Holland, Mich.), 0.61 gram of BONTRON E-88®, t-butylsalicylic acid aluminum complex, (Orient Chemical Company, Japan), and 170 grams of NORPAR 15® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 70° to 100° C. for 1 hour and cooled by running water through the attritor jacket to 18° C. and ground in the attritor for an additional 4 hours. Additional NORPAR 15®, about 170 grams in all the Examples unless otherwise indicated, was added and the mixture was separated from the steel balls yielding 358 grams of 1.284 percent solids by weight. The particle size was 6.1 microns for the V (50) (the volume weighted average particle size) measured with a Malvern 3600E particle size analyzer. The dispersion was charged by the addition of 0.460 gram of BASIC BARIUM PETRONATE® (Witco Chemical Corporation, New York, N.Y.). The mobility of the toner was measured and the result is presented hereinafter in Table 1.

TABLE 1

| EXAMPLE | ADDITIVE | CONDUCTIVITY (pmho/cm) | MOBILITY ($10^{-10}$ $m^2/Vs$) | ZETA POTENTIAL (mV) |
|---|---|---|---|---|
| Control 1 | None | 13 | −0.11 | −7 |
| Control 2 | Aluminum Stearate | 5 | −2.23 | −156 |
| Example 1 | BONTRON E-88 ® | 5 | −3.27 | −183 |

The mobility of $-3.27\times10^{-10}$ $m^2/Vs$ indicates a toner that will provide, for example, superior toner transfer efficiency, about 90 percent on a Savin 870 imaging apparatus as compared to 60 percent for the −2.23 mobility toner, thereby enabling images with better resolution, higher line resolution, and superior half toner dot resolution as compared to the liquid toner with a mobility of $-2.23\times10^{-10}$ $m^2/Vs$.

The higher mobility thus found in Example I compared to Controls 1 and 2 results in improved development and transfer.

CONTROL 3

Twenty-five (25) grams of NUCREL 599® (a copolymer of ethylene and methacrylic acid with a melt index at 190° C. of 500, available from E. I. DuPont de Nemours & Company, Wilmington, Del.), 6.3 grams of the magenta pigment (FANAL PINK TM) and 170 grams of NORPAR 15®, carbon chain of 15 average (Exxon Corporation) are added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 70° to 104° C. for 2 hours and cooled by running water through the attritor jacket to 23° C. and ground in the attritor for an additional 4 hours. Additional NORPAR 15® was added and the mixture was separated by the use of a metal grate from the steel balls. To 538 grams of the mixture (2.8 percent solids) were added 953 grams of NORPAR 15® and 0.9 gram of BASIC BARIUM PETRONATE® (Witco Chemical Corporation, New York, N.Y.). The average by area particle diameter was 2.1 microns measured with a Horiba Capa 500 particle size analyzer. The mobility of the toner was measured and the image quality was assessed using a Savin 870 copier. The results are presented hereinafter.

CONTROL 4

Twenty-five (25) grams of NUCREL 599® (a copolymer of ethylene and methacrylic acid with a melt index at 190° C. of 500 available from E. I. DuPont de Nemours & Company, Wilmington, Del.), 6.3 grams of the magenta pigment (FANAL PINK TM), 0.63 gram of aluminum stearate, available as Witco 22 from Witco Chemical Corporation, New York, N.Y., and 170 grams of NORPAR 15® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 56° to 100° C. for 2 hours and cooled by running water through the attritor jacket to 22° C. and ground in the attritor for an additional 4 hours. Additional NORPAR 15® was added and the mixture is separated from the steel balls. To 487 grams of the mixture (3.1 percent solids) were added 1,004 grams of NORPAR 15® and 0.9 gram of BASIC BARIUM PETRONATE (Witco Chemical Corporation, New York, N.Y.). The average by area particle diameter was 1.8 microns measured with a Horiba Capa 500 particle size analyzer. The mobility of the toner was measured and the image quality was assessed using a Savin 870 copier. The results are presented hereinafter.

EXAMPLE II

Twenty-five (25) grams of NUCREL 599® (a copolymer of ethylene and methacrylic acid with a melt index at 190° C. of 500, available from E. I. DuPont de Nemours & Company, Wilmington, Del.), 6.3 grams of the magenta pigment (FANAL PINK TM), 0.63 gram of BONTRON E-88® (Orient Chemical Company), and 170 grams of NORPAR 15® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 58° to 106° C. for 2 hours and cooled by running water through the attritor jacket to 23° C. and ground in the attritor for an additional 4 hours. Additional NORPAR 15® was added and the mixture was separated from the steel balls. To 493 grams of the mixture (3.04 percent solids) were added 998 grams of NORPAR 15® and 0.9 gram of BASIC BARIUM PETRONATE® (Witco Chemical Corporation, New York, N.Y.). The average by area particle diameter was 1.8 microns measured with a Horiba Capa 500 particle size analyzer. The mobility of the toner was measured and the image quality was assessed using a Savin 870 copier. The results are presented in Table 2.

TABLE 2

| EXAMPLE | ADDITIVE | MOBILITY ($10^{-10}$ $m^2/Vs$) | SOLID AREA DENSITY | TRANSFER EFFICIENCY |
|---|---|---|---|---|
| Control 3 | None | −1.05 | 0.61 | 52 |
| Control 4 | Aluminum Stearate | −1.51 | 0.99 | 67 |
| Example II | BONTRON E-88® | −1.71 | 0.94 | 69 |

CONTROL 5

Twenty-eight (28) grams of NUCREL 599® (a copolymer of ethylene and methacrylic acid with a melt index at 190° C. of 500, available from E. I. DuPont de Nemours & Company, Wilmington, Del.), 7.0 grams of the cyan pigment (PV FAST BLUE TM), and 200 grams of NORPAR 15®, carbon chain of 15 average (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 53° to 103° C. for 2 hours and cooled by running water through the attritor jacket to 17° C. and ground in the attritor for an additional 4 hours. Additional NORPAR 15® was added and the mixture was separated from the steel balls. A portion of this mixture was diluted with NORPAR 15® to make 1,500 grams of a 1.0 percent solids dispersion. To this was added 0.9 gram of BASIC BARIUM PETRONATE® (Witco Chemical Corporation, New York, N.Y.). The average by area particle diameter was 1.94 microns measured with a Horiba Capa 500 particle size analyzer. The mobility of the toner was measured and the image quality was assessed using a Savin 870 copier. The results are presented in Table 3.

CONTROL 6

Twnenty-seven (27.3) grams of NUCREL 599® (a copolymer of ethylene and methacrylic acid with a melt index at 190° C. of 500, available from E. I. DuPont de Nemours & Company, Wilmington, Del.), 7.0 grams of the cyan pigment (PV FAST BLUE TM), 0.70 gram of aluminum stearate, available as Witco 22 from Witco Chemical Corporation, and 200 grams of NORPAR 15® (Exxon Corporation) were added to a Union Process 01 attritor (Union Process Company, Akron, Ohio) charged with 0.1857 inch (4.76 millimeter) diameter carbon steel balls. The mixture was milled in the attritor which was heated with running steam through the attritor jacket at 58°to 100° C. for 2 hours and cooled by running water through the attritor jacket to ambient temperature and ground in the attritor for an additional 4 hours. Additional NORPAR 15 ® was added and the mixture was separated from the steel balls. A portion of this mixture was diluted with NORPAR 15 ® to make 1,500 grams of a 1.0 percent solids dispersion. To this was added 0.9 gram of BASIC BARIUM PETRONATE ® (Witco Chemical Corporation, New York, N.Y.). The average by area particle diameter was 1.99 microns measured with a Horiba Capa 500 particle size analyzer. The mobility of the toner was measured and the image quality was assessed using a Savin 870 copier. The results are presented in Table 3.

CONTROL 7

Twenty-five (25.0) grams of NUCREL 599 ® (a copolymer of ethylene and methacrylic acid with a melt index at 190° C. of 500, available from E. I. DuPont de Nemours & Company, Wilmington, Del.), 6.3 grams of the cyan pigment (PV FAST BLUE TM ), 0.63 gram of BONTRON E-84 ® (zinc t-butylsalicylate, Orient Chemical Company) and 170 grams of NORPAR 15 ® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 55° to 99° C. for 2 hours and cooled by running water through the attritor jacket to 18° C. and ground in the attritor for an additional 4 hours. Additional NORPAR 15 ® was added and the mixture was separated from the steel balls. A portion of this mixture was diluted with NORPAR 15 ® to make 1,500 grams of a 1.0 percent solids dispersion. To this was added 0.9 gram of BASIC BARIUM PETRONATE ® (Witco Chemical Corporation, New York, N.Y.). The average by area particle diameter was 2.25 microns measured with a Horiba Capa 500 particle size analyzer. The mobility of the toner was measured and the image quality was assessed using a Savin 870 copier. The results are presented in Table 3.

Control 8

Twenty-five (25.0) grams of NUCREL 599 ® (a copolymer of ethylene and methacrylic acid with a melt index at 190° C. of 500, available from E. I. DuPont de Nemours & Company, Wilmington, Del.), 6.3 grams of the cyan pigment (PV FAST BLUE), 0.63 gram of LR-120 (Boron t-butylsalicylate, Nippon Carlit of Japan) and 170 grams of NORPAR 15 ® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 55° to 102° C. for 2 hours and cooled by running water through the attritor jacket to 16° C. and ground in the attritor for an additional 4 hours. Additional NORPAR 15 ® was added and the mixture was separated from the steel balls. A portion of this mixture was diluted with NORPAR 15 ® to make 1,500 grams of a 1.0 percent solids dispersion. To this was added 0.6 gram of BASIC BARIUM PETRONATE ® (Witco Chemical Corporation, New York, N.Y.). The average by area particle diameter was 1.98 microns measured with a Horiba Capa 500 particle size analyzer. The mobility of the toner was measured and the image quality was assessed using a Savin 870 copier. The results are presented in Table 3.

EXAMPLE III

Twenty-five (25.0) grams of NUCREL 599 ® (a copolymer of ethylene and methacrylic acid with a melt index at 190° C. of 500, available from E. I. DuPont de Nemours & Company, Wilmington, Del.), 6.3 grams of the cyan pigment (PV FAST BLUE TM ), 0.63 gram of BONTRON E-88 ® (aluminum t-butylsalicylate, Orient Chemical Company) and 170 grams of NORPAR 15 ® (Exxon Corporation) were added to a Union Process 01 attritor (Union Process Company, Akron, Ohio) charged with 0.1857 inch (4.76 millimeters) diameter carbon steel balls. The mixture was milled in the attritor which was heated with running steam through the attritor jacket at 54° to 102° C. for 2 hours and cooled by running water through the attritor jacket to ambient temperature and ground in the attritor for an additional 4 hours. Additional NORPAR 15 ® was added and the mixture was separated from the steel balls. A portion of this mixture was diluted with NORPAR 15 ® to make 1,500 grams of a 1.0 percent solids dispersion. To this was added 0.9 gram of BASIC BARIUM PETRONATE ® (Witco Chemical Corporation, New York, N.Y.). The average by area particle diameter was 1.63 microns measured with a Horiba Capa 500 particle size analyzer. The mobility of the toner was measured and the image quality was assessed using a Savin 870 copier. The results are presented in Table 3.

TABLE 3

| EXAMPLE | ADDITIVE | MOBILITY ($10^{-10}$ $m^2/Vs$) | SOLID AREA DENSITY | TRANSFER EFFICIENCY |
|---|---|---|---|---|
| Control 5 | None | −0.65 | 0.60 | 39 |
| Control 6 | Aluminum Stearate | −1.44 | 1.20 | 80 |
| Control 7 | BONTRON E-84 ® | −1.10 | 0.82 | 53 |
| Control 8 | LR-120 | −0.61 | *Unacceptable Mixture of Positive and Negative | *Unacceptable Mixture of Positive and Negative |
| Example III | BONTRON E-88 ® | −2.31 | 1.31 | 93 |

*Toner comprised of a mixture of negatively charged toner and positively charged toner, therefore, these toners would provide unacceptable background development.

Other embodiments and modifications of the present invention may occur to those skilled in the art subsequent to a review of the information presented herein, these embodiments and modifications, as well as equivalents thereof, are also included within the scope of this invention.

What is claimed is:

1. A negatively charged liquid developer comprised of a nonpolar liquid, thermoplastic resin particles, a nonploar liquid soluble ionic or zwitterionic charge director, and a charge adjuvant comprised of an aluminum hydroxycarboxylic acid, or mixtures thereof; and wherein said charge adjuvant is incorporated into said thermoplastic resin particles and said thermoplastic resin particles are dispersed in said nonpolar liquid and said liquid soluble charge director.

2. A negatively charged liquid electrostatographic developer consisting essentially of a dispersion of nonpolar liquid, thermoplastic resin particles, pigment particles, a nonpolar liquid soluble ionic or zwitterionic charge director compound, and a charge adjuvant comprised of an aluminum hydroxycarboxylic acid; and wherein said dispersion consists essentially of particles of said thermoplastic resin having incorporated therein, said pigment and said charge adjuvant in said nonpolar liquid and said charge director compound.

3. A negatively charged liquid electrostatographic developer comprised of (A) a nonpolar liquid having a Kauri-butanol value of from about 5 to about 30 and present in a major amount of from about 50 percent to about 95 weight percent; (B) thermoplastic resin particles having an average volume particle diameter of from about 5 to about 30 microns, and pigment particles; (C) a nonpolar liquid soluble ionic or zwitterionic charge director compound; and (D) a charge adjuvant comprised of aluminum hydroxycarboxylic acid, the corresponding hydrates, or mixtures thereof; and wherein said pigment particles and said charge adjuvant are incorporated into said thermoplastic resin particles and said thermoplastic resin particles are dispersed in a mixture of said nonpolar liquid and said charge director compound.

4. A developer in accordance with claim 2 wherein the aluminum hydroxycarboxylic acid charge adjuvant is an aluminum alkylsalicylic acid.

5. A developer in accordance with claim 2 wherein the aluminum hydroxycarboxylic acid charge adjuvant is aluminum di-tertiary-butylsalicylic acid.

6. A developer in accordance with claim 1 wherein the resin particles are comprised of a copolymer of ethylene and an $\alpha,\beta$ethylenically unsaturated acid selected from the group consisting of acrylic acid and methacrylic acid.

7. A developer in accordance with claim 1 wherein the resin particles are comprised of a styrene polymer, an acrylate polymer, a methacrylate polymer, a polyester, or mixtures thereof.

8. A developer in accordance with claim 2 wherein the resin particles are selected from the group consisting of copolymers of ethylene and vinyl acetate, polypropylene, polyethylene, and acrylic polymers.

9. A developer in accordance with claim 1 wherein the resin particles are comprised of a copolymer of ethylene, and acrylic or methacrylic acid, an alkyl ester of acrylic or methacrylic acid wherein alkyl contains from 1 to about 5 carbon atoms or a copolymer of ethylene, and methacrylic acid with a melt index at 190° C. of 500.

10. A developer according to claim 1 further containing a colorant.

11. A developer according to claim 10 wherein the colorant is a pigment or a dye.

12. A developer in accordance with claim 11 wherein the pigment is cyan, magenta, yellow, red, green, blue, brown, or mixtures thereof, or carbon black.

13. A developer in accordance with claim 1 wherein the charge director is present in an amount of from about 2 to about 10 weight percent.

14. A developer in accordance with claim 2 wherein component (A) is present in an amount of from 85 percent to 99.9 percent by weight, based on the total weight of the developer solids of resin, pigment, and charge adjuvant which is present in an amount of from about 0.1 percent to about 15 percent by weight; and component (C) is present in an amount of from about 0.25 to about 1,500 milligrams/gram of the developer solids comprised of resin, pigment, and charge adjuvant.

15. A developer in accordance with claim 2 wherein component (D) is present in an amount of 0.1 to 40 percent by weight based on the total weight of developer solids.

16. A developer in accordance with claim 2 further containing a second charge adjuvant selected from the group consisting of polyhydroxy compounds which contain at least 2 hydroxy groups, an amino alcohol, polybutylene succinimides and metallic soaps.

17. A developer in accordance with claim 1 wherein the liquid is an aliphatic hydrocarbon.

18. A developer in accordance with claim 17 wherein the aliphatic hydrocarbon is a mixture of branched hydrocarbons with from about 12 to about 16 carbon atoms.

19. A developer in accordance with claim 17 wherein the aliphatic hydrocarbon is a mixture of normal hydrocarbons with from about 12 to about 16 carbon atoms.

20. A developer in accordance with claim 2 wherein component (C) is an oil-soluble petroleum sulfonate.

21. A developer in accordance with claim 2 wherein component (C) is lecithin, and the resin is a linear polyester.

22. A developer in accordance with claim 2 wherein component (C) is a quaternary ammonium block copolymer compound.

23. A developer in accordance with claim 1 wherein the resin particles are an alkylene polymer, a styrene polymer, an acrylate polymer, a polyester, or mixtures thereof.

24. A developer in accordance with claim 1 wherein the charge adjuvant is comprised of a mixture of 1:1, 1:2, and 1:3 of said aluminum hydroxycarboxylic acid.

25. An imaging method which comprises forming an electrostatic latent image followed by the development thereof with the liquid developer of claim 1.

26. An imaging method which comprises forming an electrostatic latent image followed by the development thereof with the liquid developer of claim 3.

27. A liquid developer in accordance with claim 2 wherein the pigment particles are selected from the group consisting of cyan, magenta, yellow, red, green, blue, brown, carbon black and mixtures thereof.

28. A developer in accordance with claim 2 wherein the charge adjuvant is aluminum ditertiarybutylsalicylic acid present in an amount of from about 0.1 percent to about 15 percent by weight based on the total weight of the developer solids of resin, pigment and charge adjuvant.

* * * * *